US005152471A

United States Patent [19]

Goerner

[11] Patent Number: 5,152,471

[45] Date of Patent: Oct. 6, 1992

[54] WEB THREADING APPARATUS FOR WEB SLITTING MACHINES

[75] Inventor: Bernd Goerner, Weilheimm/Teck, Fed. Rep. of Germany

[73] Assignee: Beloit Corporation, Beloit, Wis.

[21] Appl. No.: 267,139

[22] Filed: Nov. 4, 1988

[30] Foreign Application Priority Data

Nov. 5, 1987 [DE] Fed. Rep. of Germany ..... 3737504

[51] Int. Cl.[5] ..... B65H 35/02

[52] U.S. Cl. ..... 242/56.4; 226/92; 226/109; 242/56 R

[58] Field of Search ..... 242/56 R, 56 A, 56.1-56.9, 242/195; 226/91, 92, 95, 97, 109, 116

[56] References Cited

U.S. PATENT DOCUMENTS

| | | | |
|---|---|---|---|
| 2,862,705 | 12/1958 | Faeber | 226/92 |
| 3,539,127 | 11/1970 | Grawey | 242/56.9 X |
| 3,844,189 | 10/1974 | Jardine | 242/56 A X |
| 3,921,878 | 11/1975 | Zangenfeind | 226/109 X |
| 4,309,830 | 1/1982 | Vits | 226/92 X |
| 4,686,778 | 8/1987 | Kotitschke et al. | 242/195 X |
| 4,775,110 | 10/1988 | Welp et al. | 242/56.8 |

FOREIGN PATENT DOCUMENTS

| | | | |
|---|---|---|---|
| 2409492 | 9/1975 | Fed. Rep. of Germany | 226/95 |
| 1462219 | 1/1977 | United Kingdom . | |
| 2131773 | 6/1984 | United Kingdom | 242/56 R |

OTHER PUBLICATIONS

Beloit "High Torque Conterwinder (HTC) Winder", date unknown.

*Primary Examiner*—Daniel P. Stodola
*Assistant Examiner*—P. Bowan
*Attorney, Agent, or Firm*—Dirk J. Veneman; Raymond W. Campbell; Gerald A. Mathews

[57] ABSTRACT

A web threading apparatus for a web slitting machine which longitudinally divides a wide web in a slitting or cutting station, including a threading device having a threading rod guided by chains through the machine. The threading device supplies first and second groups of sub-webs to first and second groups of associated winding apparatus.

7 Claims, 11 Drawing Sheets

WEB THREADING APPARATUS FOR WEB SLITTING MACHINES

BACKGROUND OF THE INVENTION

This invention relates to a web slitting machine of the type in which a supply roll is unwound, the web is slit and the individual sub-webs are rewound on individual cores in a continuous operation. More particularly the invention relates to apparatus for threading the web and the sub-webs through the machine up to the individual take-up units for each sub-web.

Web cutting or slitting machines are commonly used in the paper industry. In a common design, a supply roll unwind station, guide rollers, and slitters are provided, and downstream of the slitters two stationarily mounted support rollers are arranged at the same height, with transverse spacing from each other. Normally the support rollers include vacuum means. The narrower rolls made from the sub-webs are wound supported by the drums. At the start of the slitting and winding operation, the roll cores, which may consist of cardboard for the narrower rolls, bear on the respective support rollers and at their ends are held by means of suitable clamping means on support arms pivotal against the surface of the support rollers. The end of the sub-web, which is held by the vacuum of the respective support roller, is connected to the reel core, whereupon coiling begins, and the narrower roll is coiled from the respective sub-web on the support roller.

At the start of the working operation, the web must be withdrawn from the wide roll, inserted into the unwinding station and drawn along a guide means formed by a plurality of guide rollers and into the slitter. Following the slitting station in which the wide web is divided into a number of narrower sub-webs, the adjacent sub-webs are alternately conducted to take-up units at the one and the other support roller. The process of drawing the web from the wide supply roll, through the guide rolls and slitter and to the take-up cores, is known as threading.

The take-up units of a support roller have winding axes which are formed by the axes of the roll cores, and which, although they are displaced in the course of the winding by the increasingly larger roll diameter of the narrower rolls, remain substantially in alignment. The take-up units of one support roller form one group, the take-up units of the other support roller form a second group.

The invention is not restricted to the type of winding referred to, i.e. in which two support rollers are present and the winding takes place onto narrower rolls running onto the support rollers. Other take-up units are known which operate with one support roller or no support roller. However, a common property of the designs to which the invention is applicable is that the adjacent sub-webs are conducted alternately to two groups of take-up devices, the winding axes of the groups being spaced apart so that the narrower rolls formed cannot touch each other. By separating the take-up axes of adjacent sub-webs, space is provided for the clamping means engaging the cores of the narrower rolls, and for the corresponding support arms of the clamping means. Thus, in the web slitting machine, these elements extend into the intermediate spaces between axially consecutive narrower rolls of a group of take-up devices.

Threading the web from the wide roll into the unwinding station and slitter, and, in particular, threading the sub-webs amongst the two groups of take-up units, in the past has been carried out by hand. Hand threading represents a time-consuming operation which also involves a certain risk of injury for the operating personnel.

In the company publication of Beloit Lenox Inc., Lenox Mass. (USA) entitled "High Torque Centerwind (HTC) Winder" a web slitting machine is known, which has one support roller against which the roll cores of the narrower rolls are applied from two sides. Threading is by means of a device which includes a rod extending transversely of the web, and which is movable along the path of the web defined by the guide rollers. The web end is connected to the threading rod, for example by adhesives or clips, whereupon the threading rod is set in motion and draws the web along its path through the various stations up to behind the cutting station or slitter. However, bringing the sub-webs formed after the cutting station up to the individual take-up units, which are arranged in two groups having winding axes transversely spaced apart, is then performed by hand, and thus involves delay and a tedious operation for the operating personnel which is not without danger.

A principal object of the present invention is to provide in a web slitting machine an automatic web threading device operating up to the take-up units of each of the individual groups of take-up units.

Another object of the present invention is to provide a web threading apparatus which increases threading efficiency and decreases the amount of time required for threading a web slitting machine, and which can be used regardless of the widths of sub-webs being formed.

Yet another object of the present invention is to provide an apparatus for threading webs through a web slitting machine which reduces the risk of personal injury to operators by eliminating many of the dangerous operations previously performed by hand.

SUMMARY OF THE INVENTION

The above and other objects are achieved in the present invention by means of a threading device which carries the web up to the cutting station or slitter, and which additionally carries the sub-webs created at the cutting station to the individual take-up units in the groups of take-up units at the point of sub-web rewinding.

In one embodiment of the invention, the threading device previously used for threading up to the slitters at the cutting station is extended in its function in that it leads the sub-webs present after the cutting station successively up to the take-up units of the different groups. With two groups of take-up units, the threading device first entrains all the sub-webs to the one group of take-up units, and then, after the detachment of the sub-webs to be wound in the first group of take-up units, the threading device returns to the slitter and brings the remaining sub-webs up to the other group of take-up units.

In an alternative embodiment, there is associated with the threading device, which can be constructed in a manner known per se for pulling the web up to behind the cutting station, a separate distributing device which performs the distribution of the sub-webs amongst the take-up units of the various groups, i.e. the distributing device brings up a first total set of sub-webs, which are not immediately adjacent each other at the slitter, to the take-up units of one group, and then brings another total set of sub-webs not adjacent each other at the slitter up to the take-up units of another group.

In a third preferred embodiment, the separate distributing device means associated with the threading device does not perform the final threading of all the sub-webs to the take-up units of all groups, but instead only the final threading of all sub-webs to the take-up units of one group, whilst the final threading to the take-up units of the other group is effected by the primary threading device itself.

The threading rod and/or the distributing device may comprise an elongated gripping element which is guided at its ends by lateral, flexible pulling members and which move and guide the gripping element along a path defined by the route for the web.

A guide roller and pressure roller are provided after the cutting station for guiding and securing the sub-webs formed. The pressure roller is pivotal away from the guide roller to allow the gripping element of the threading device to pass, i.e. the threading rod with the paper web secured thereto. After the threading rod has passed the gap between the guide roller and pressure roller the gap is closed, and the web is thus prevented from slipping back beyond this point, for example, during the transfer of the sub-webs by the distributing device.

Additional objects and advantages of the present invention will be apparent from the detailed description and the accompanying drawings.

DETAILED DESCRIPTION OF PREFERRED EMBODIMENTS

Figure 1:
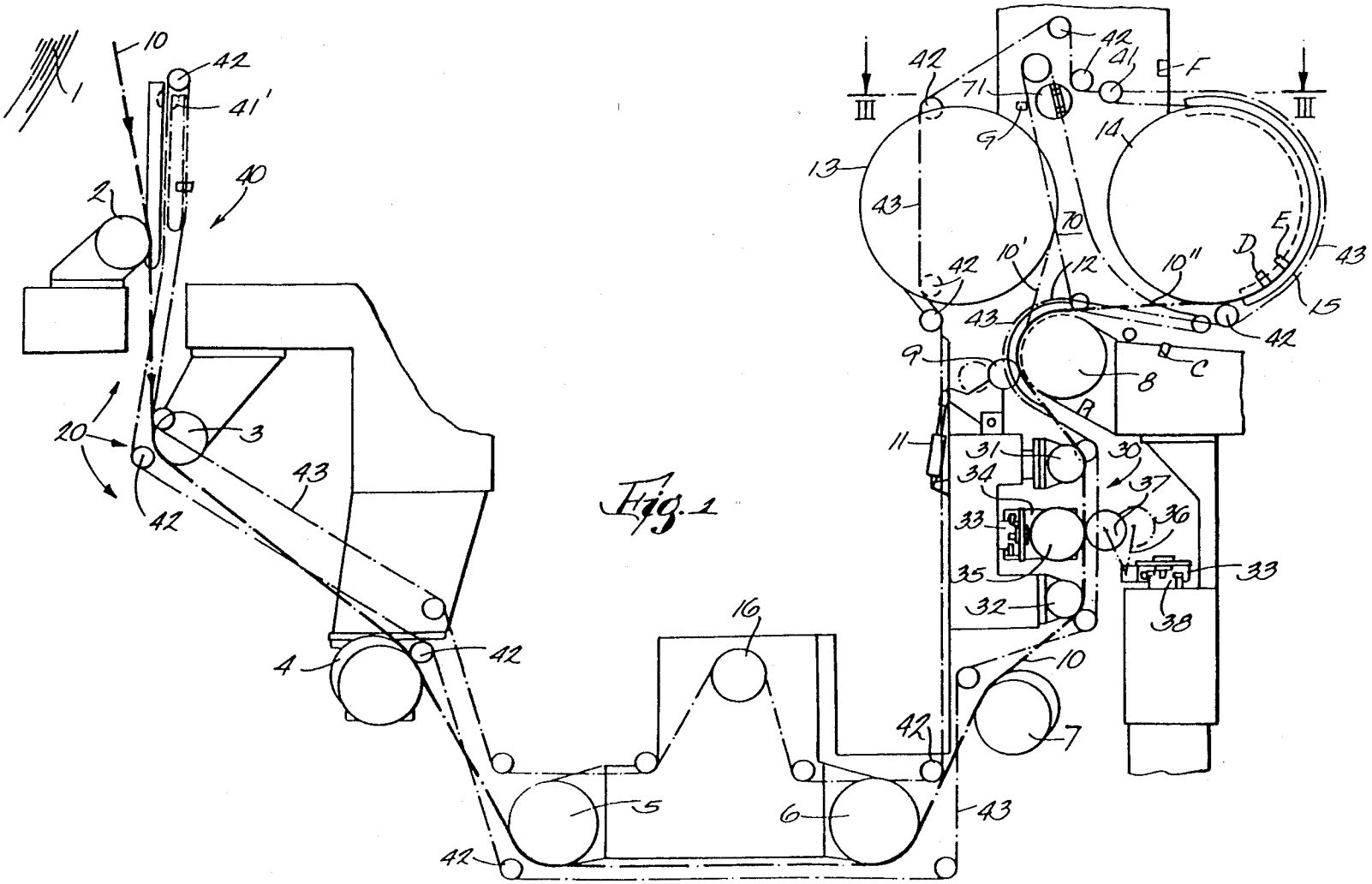
FIG. 1 is a side view of a web slitting machine having web threading apparatus embodying the present invention.

Referring now more particularly to the drawings, and to FIG. 1 in particular, the unwinding station is indicated on the left side, in the left upper corner, and includes a wide paper supply roll 1 which may have a width of up to 8 to 10 meters. The correspondingly wide paper web 10 is unwound from the roll 1 in the direction of the arrow, and is led via guide rollers 2 and 3 bearing on different sides of the web 10 up to a broad drawing roller 4. The web 10 then passes via two additional guide rollers 5 and 6 and a drawing roller 7 into a cutting station or slitter designated by numeral 30. The web 10 is longitudinally slit in the cutting station 30 into parallel, adjacent sub-webs 10', 10'' (FIG. 3) which then pass onto a guide roller 8, against which a pivotally retractable pressure roller 9 can be applied from the opposite side of the web, the web 10 being conducted through the gap between the rollers 8, 9.

The combination of the rollers 2, 3, 4, 5, 6, 7, 8, and 9 forms a guide means denoted as a whole by the numeral 20, by means of which the web is led on its path through the slitting or cutting machine from the unwind station to the individual rewind devices. The guide means operates so that the web 10 is conducted with only short, free lengths being mostly supported over rollers, so that the web remains taut and free of creases.

The roll cutting machine further includes an automatic threading device 40 having a threading rod 41 which is guided by endless chains 43 operating laterally outside the web width, the chains being directed over a number of deflection rollers 42 from the roll 1 up to just behind the guide roller 8. For this purpose, the start of the web 10 is adhered or clipped to the threading rod 41 disposed in the starting position 41', i.e. secured with spring members which clamp the end of the web 10 to the threading rod 41, the web being laid around the threading rod 41. This operation of attaching the web to the rod is carried out by hand. After connecting the web 10 to the drawing-in rod 41, the rod begins to move, being guided along the path prescribed by the endless chains 43, with the end of the web 10 secured to the rod. The rod entrained by the chains 43 moves generally along the guide means 20, as indicated by the arrows in FIG. 1, the arrangement of the deflection rollers 42 ensuring that the chains 43 and thus the threading rod 41 are always led past the various rollers 2 through 8 at the side of the roller on which the web 10 is to run during operation.

The cutting station 30 includes, in the example of the embodiment shown, two vertically superimposed guide rollers 31 and 32 between which, at a guide 33 extending transversely of the web, a series of blade carriages 34 are arranged for a series of lower blades 35. On the side of the web 10 opposite the blade carriages 34 are blade carriages 36 with upper blades or knives 37, the carriages 36 being movable along a guide 38 extending transversely of the web. The carriages 36 are movable through the same distances as the blade carriages 34, so that the associated pairs of blades 35, 37 always cooperate properly to slit the web. The upper blade 37 may be pivoted away in the manner indicated by phantom lines in FIG. 1 so that, when threading the web 10, the threading rod 41 with the web end secured thereto can be led through the slitter between the blade pairs 35 and 37.

In a similar manner, by means of a cylinder 11, the pressure roller 9 can also be pivoted away, to allow the threading rod 41 to pass between the rollers 8 and 9. As apparent from the drawings, the chain 43 is led in the region of the guide roller 8 over a semicircular guide rail 12, so that the threading rod is held at the proper distance from the surface of the guide roller 8.

Above the cutting station 30 and the rollers 8 and 9, two support rollers 13 and 14 are positioned, extending over the width of the web 10 at the same level, but horizontally spaced apart. The support rollers 13 and 14 are both driven and cooperate with the take-up units still to be described to form the narrower rolls made from the sub-webs 10', 10''.

The chain 43 of the threading device 40 is also led outwardly around the support roller 14 by a semicircular guide rail 15. The chain 43 then runs over a number of further deflection rollers 42, passes the drive 16, and returns to the vicinity of the wide roll 1, where the threading rod 41 is disposed in the initial position 41'.

Figure 2:
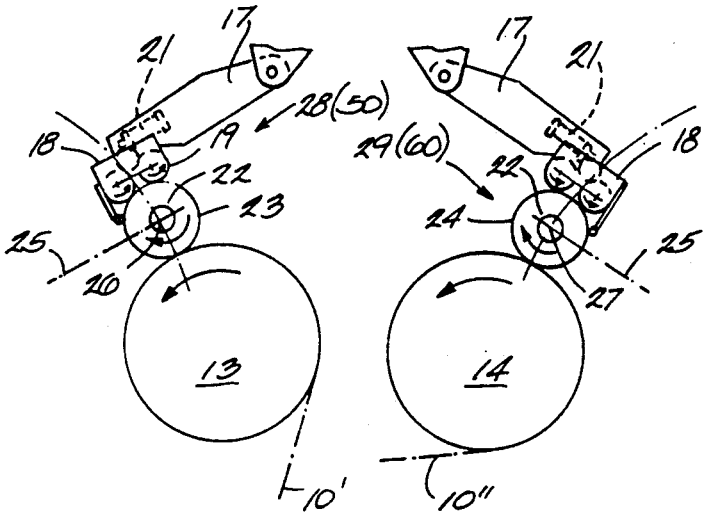
FIG. 2 is, in reduced scale, a partial side view of the groups of take-up units in the slitting machine shown in FIG. 1.

FIG. 2 indicates the formation of the narrower rolls from the sub-webs obtained from the web in the slitting or cutting station 30. The sub-webs 10' are supplied in a manner to be explained hereinafter to the left support roller 13, and the sub-webs 10'' to the right support roller 14. The support rollers 13, 14 are constructed as suction rollers and can securely hold the sub-webs 10', 10'' brought up to them. Above the support rollers 13, 14 roller cranks 17, which are pivotal about a transverse axis, are mounted. At the free ends of the cranks 17, roller rockers are likewise pivotally mounted, each comprising two rider rollers 19. The roller rockers 18 can be adjusted in their pivot position by actuating the cylinders 21.

The rider rollers 19 serve to grip the cores 22 which are brought onto the upper side of the support roller 13 or 14 by core supply means not shown. The cores 22 may have the form of a cardboard tube of length corresponding to the width of the sub-webs 10', 10''. The rider rolls also adjust the cores parallel to the axis, so that the cardboard tube can be gripped at its two ends by clamping means which are disposed on the ends of support arms 25. Associated with each sub-web 10' or 10'' is such a pair Of support arms which extend outside the ends of the core 22 and engage with their clamping means from the outside into the ends of the core 22.

Figure 3:
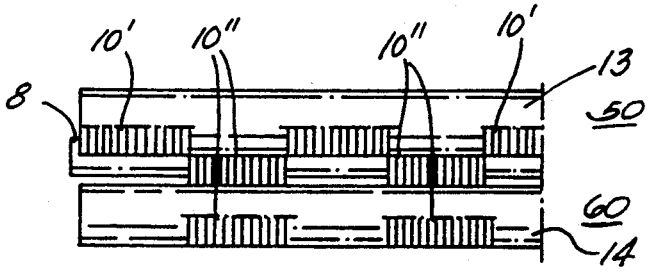
FIG. 3 is a partial view along the line III—III of FIG. 1, again in reduced scale.

The end of a sub-web 10' or 10'', held by vacuum to a support roller 13 or 14, is secured by means also not illustrated to the associated core 22. The support rollers 13, 14 then start rotating, and the sub-web 10' or 10'' is wound onto the respective core 22 to form narrower rolls 23 and 24 corresponding to the width of the sub-webs 10', 10''. The narrower rolls 23 formed from the sub-webs 10' on the support roller 13 are offset in a longitudinal or cross-web direction with respect to the narrower rolls 24 formed from the sub-webs 10'' on the support roller 14, as indicated in FIG. 3. The intermediate spaces between neighboring ones of the narrower rolls 23 or 24 of each support roller 13 or 14 are necessary for the support arms 25 to have room between the ends of neighboring narrower rolls 23 or 24.

The winding axes 26 of the narrower rolls wound onto the support roller 13 are substantially in alignment. However, with increasing diameter of the narrower rolls 23, the axes 26 move along a circular arc which is defined by the support arms 25. The same applies to the winding axes 27 of the narrower rolls 24 on the support roller 14.

All of the elements serving to make a narrower roll 23 form a take-up unit denoted as a whole by numeral 28, and all of the corresponding elements for a roll 24 form a take-up unit denoted by numeral 29. The take-up units 28, the number of which corresponds to the number of sub-webs to be wound on the left support roller 13, form a group 50. The take-up units 29 form a group 60 as indicated in FIGS. 2 and 3.

The problem in threading, which heretofore has resulted in final threading being performed by hand, is that the groups 50 and 60 are spaced apart. The web 10, which is guided in a plane up to the roll nip 8 and 9, must be divided, with sub-webs 10', adjacent ones of which are spaced, being supplied to the group 50, and the remaining sub-webs 10'' to the group 60. The neighboring sub-webs of each group are spaced the width of the sub-web adjacent each at the slitter, which is supplied to the other group.

The supply of adjacent sub-webs alternately to different groups is done in the example of FIGS. 1 to 8 with the aid of a transfer or distributing device which is designated as a whole by numberal 70, and the function of which will be explained in detail with the aid of FIGS. 4 to 8.

Figure 4:
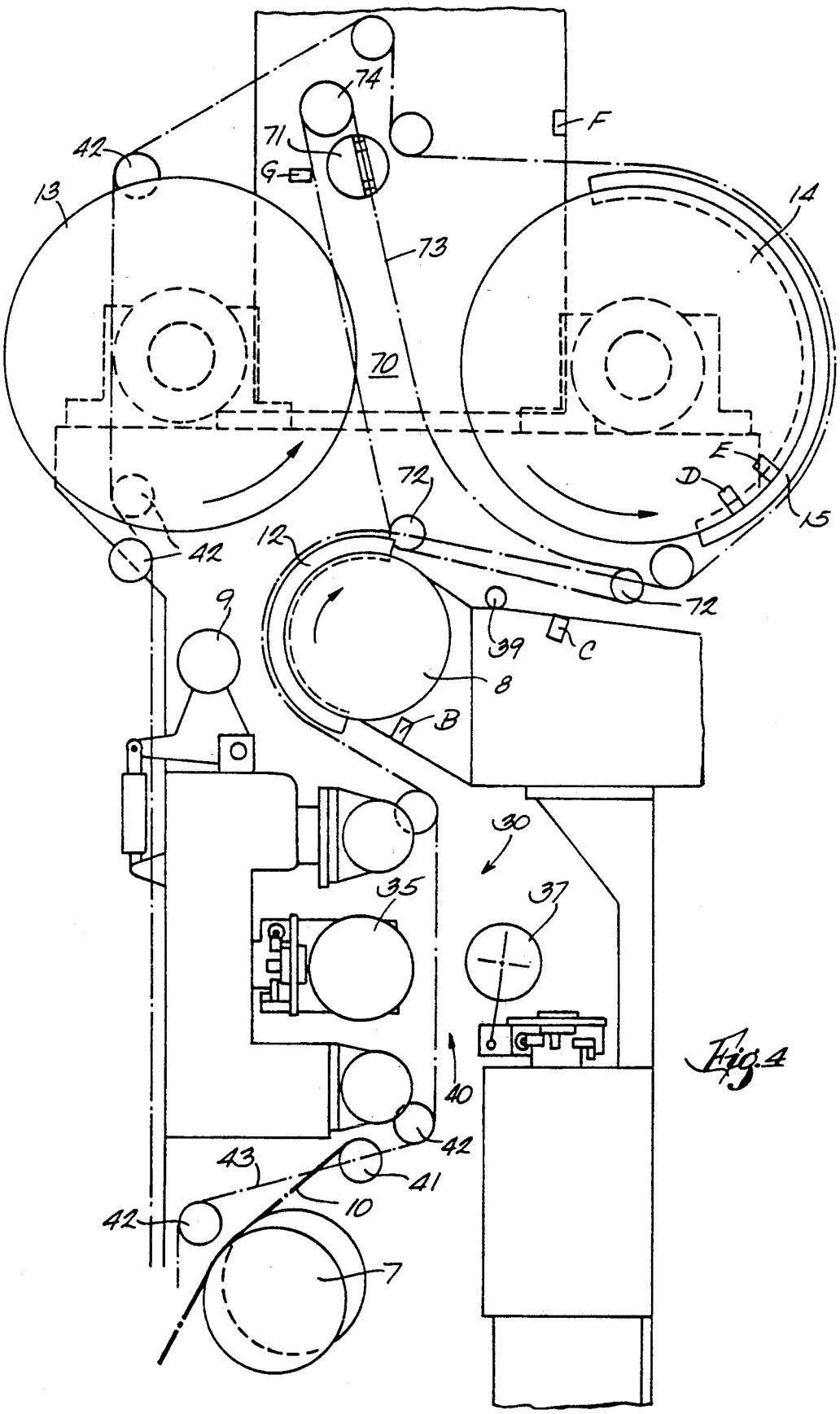
FIG. 4 is an enlarged partial view of the right part of FIG. 1, showing the web threading apparatus from and following the cutting station.

As apparent from FIG. 4, the distributing device 70 includes an elongated gripping element for sub-webs in the form of a suction tube 71 which extends transversely over the web width, and which, at the two sides of the web, is movable on chains 73 guided via deflection rollers 72 in the region between the support rollers 13, 14. A drive for the chains is denoted by 74. The suction tube 71 can be brought out of a position as illustrated in FIG. 4 downwardly into the vicinity of the portion of the web 10 running between the guide roller 8 and the support roller 14 in such a manner that sub-webs gripped by the suction tube and entrained thereby pass the support roller 13 so closely that the sub-webs are removed from the suction tube as a result of the vacuum from the roller. The two deflection rollers 72 are arranged just below the support rollers 13 and 14 and the drive roller 74 is arranged just above said rollers.

All the drives of the roll cutting machine, i.e. the drives of the support rollers 13, 14, the drives 16 and 74 of the chains 43 and 73, and the drive of the guide roller 8, are variable in speed and controllable in mutual dependence.

The use and operation of a web threading apparatus as specified previously herein will now be described with reference to the step wise illustration of FIGS. 5 through 8.

Figure 5:
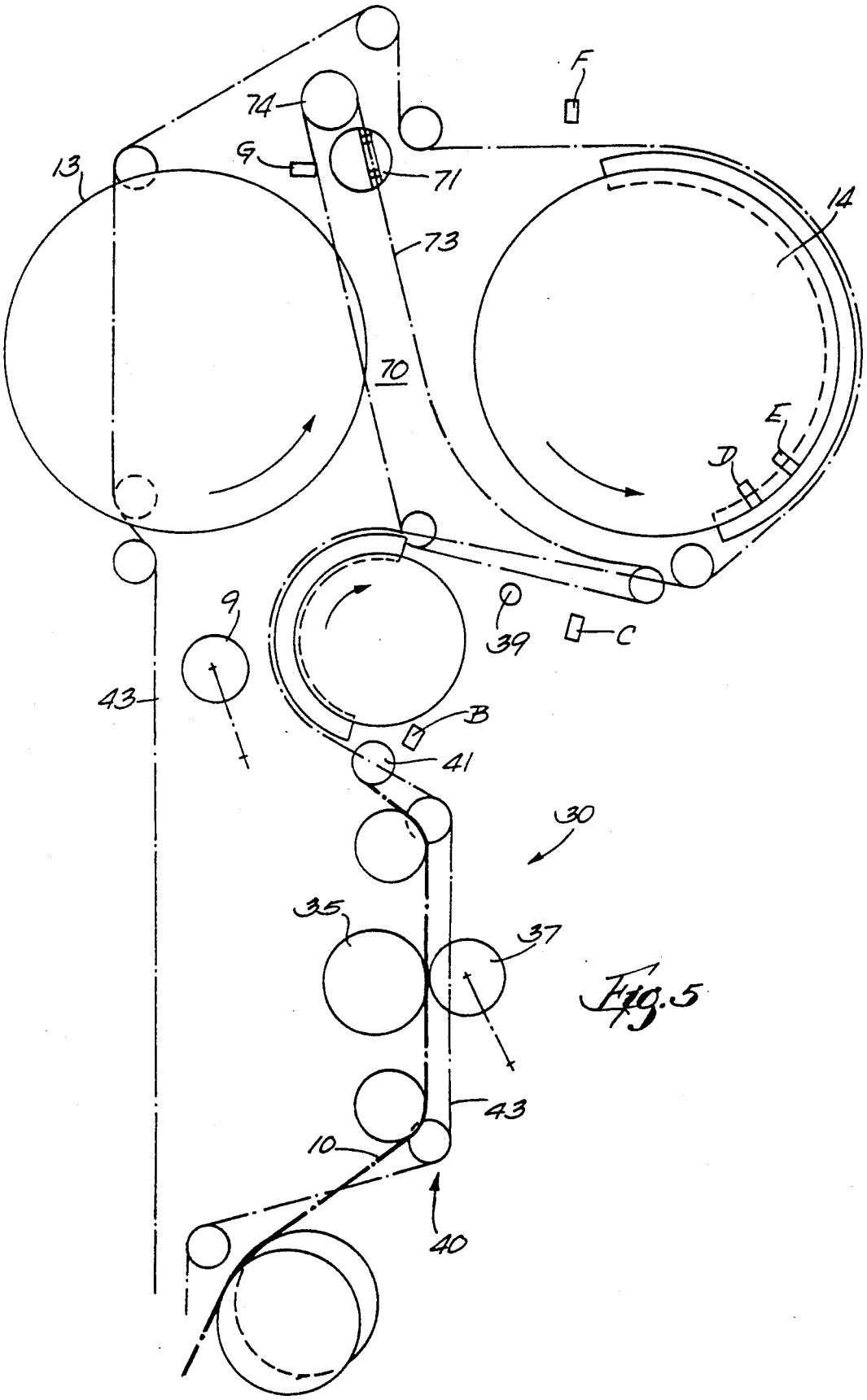
FIGS. 5 through 8 are simplified views corresponding essentially to FIG. 4, but illustrating only essential functional elements, and depicting different working phases of the web threading apparatus.

The paper web 10 is firstly drawn forward up to behind the cutting station 30 whereupon the upper blades 37 operate and the longitudinal division begins (FIG. 5).

Figure 6:
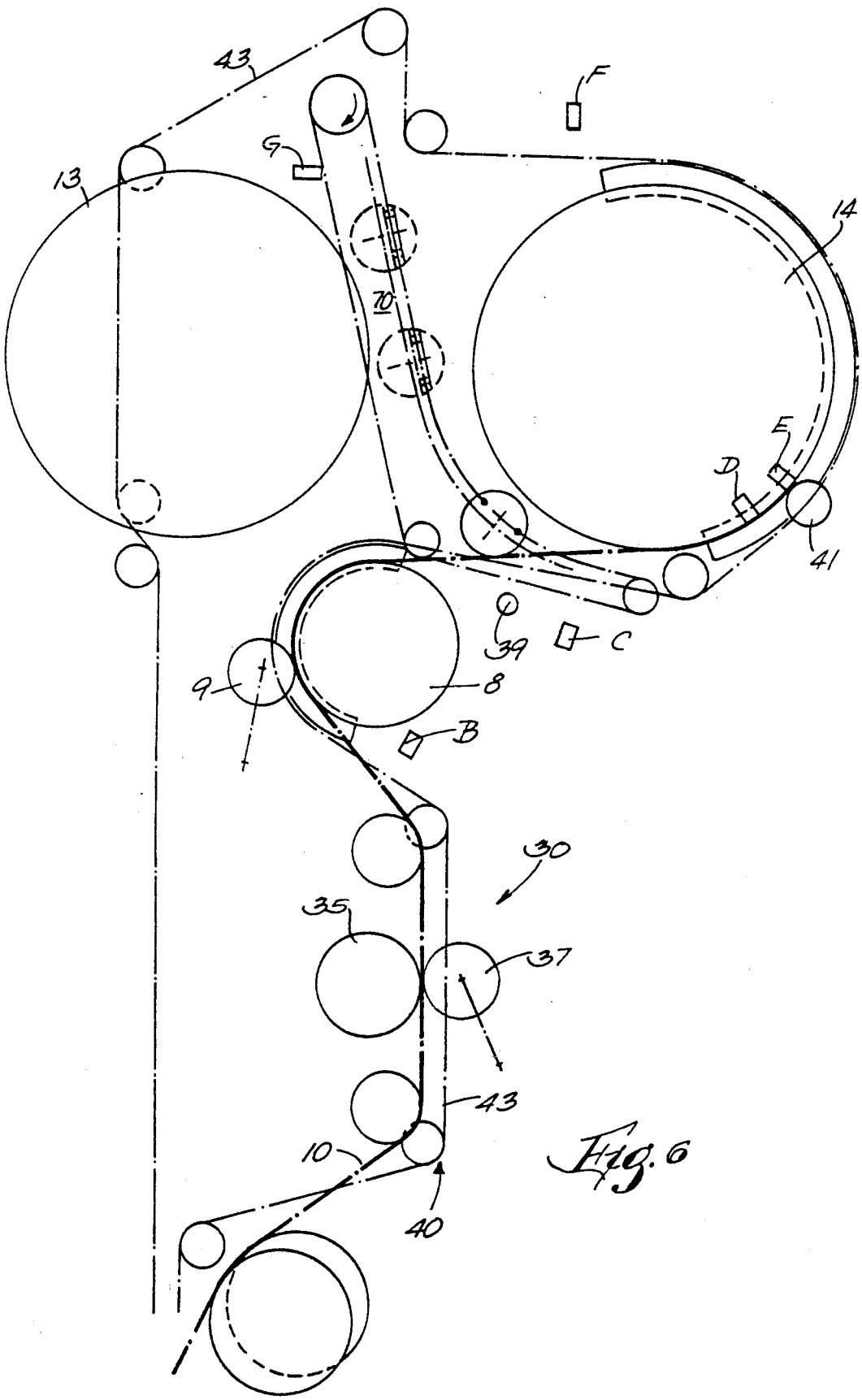

The threading rod 41 draws the sub-webs 10', 10'' formed at the cutting station between the rollers 8 and 9 toward the support roller 14. The threading rod is stopped as it approaches the proximity switch E (FIG. 6). After a predetermined time, the drive 16 of the threading rod 41 is reversed so that the threading rod 41 moves back to the proximity switch D. The position of the proximity switch D is so chosen that the suction tube 71, which has been moved to the proximity switch C and has been stopped, bears with slight pressure from above on the web 10, and can exert its suction action on the web. This condition is shown in FIG. 7.

Backwards slipping of the web 10 through the cutting station 30 when moving the threading rod 41 back from switch E to switch D is prevented because the web is held firmly between the guide roller 8, which is driven and therefore not readily rotatable by the web 10, and the pressure roller 9.

In the region in which the suction tube 71 bears thereon, the web 10 is already divided into sub-webs 10' and 10''. The sub-webs 10'' intended for the support roller 14 have already been captured by the vacuum from the support roller 14. The sub-webs 10' intended for the support roller 13 are now separated or cut by hand in the section between the suction tube 71 and the threading rod 41, and are then captured by the suction tube 71. In response to a corresponding signal, the drive 16 is set in operation again so that the threading rod 41 continues along its path around the support roller 14. The drive 74 is also again started, but in the opposite direction as previously, so that the suction tube 71 is led upwardly. The suction tube 71 entrains the loose ends of the sub-webs 10', and brings the sub-webs so closely up to the support roller 13 that the latter can engage the sub-web ends due to its own suction action. This phase is shown in FIG. 8.

Figure 7:
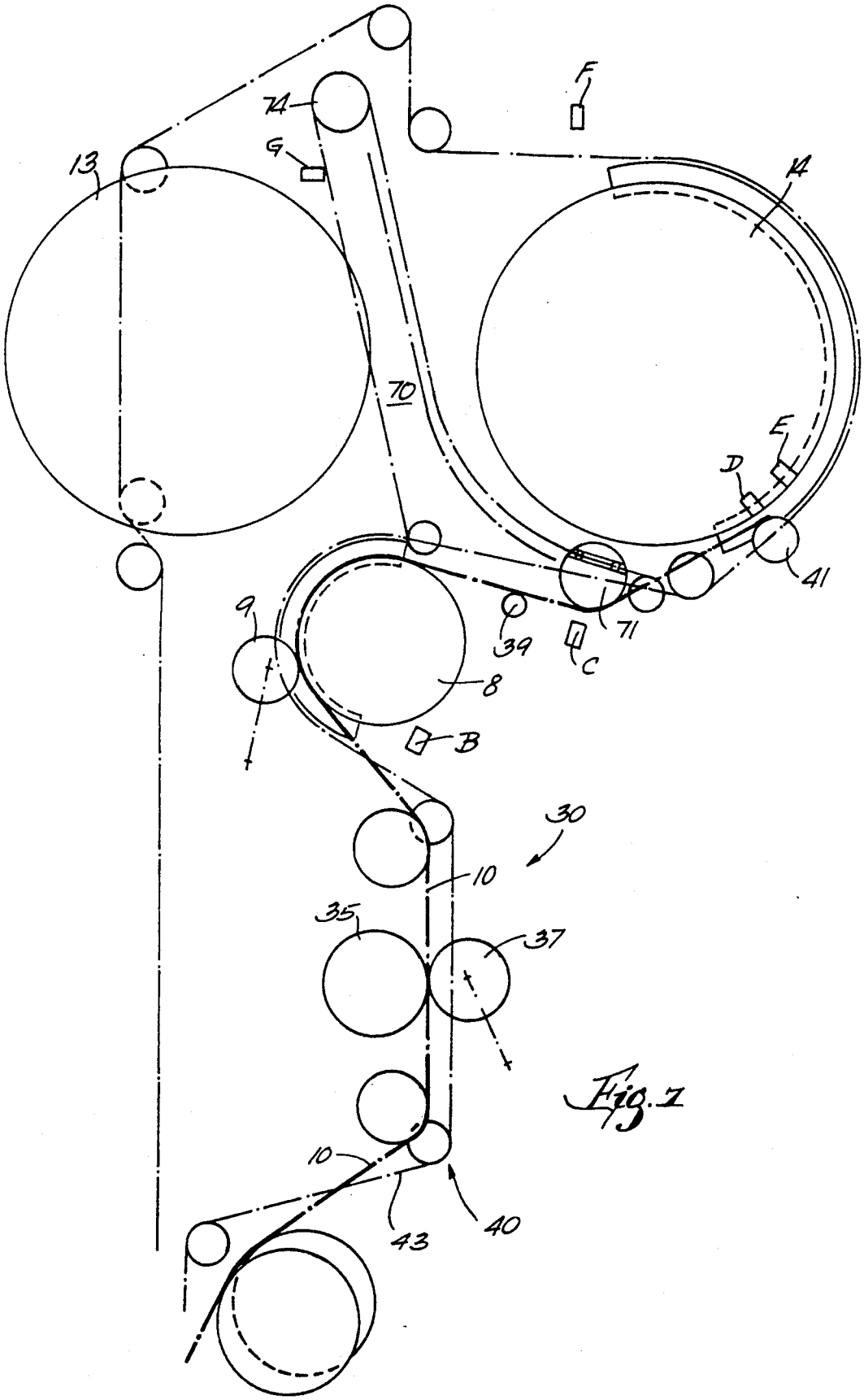
Figure 8:
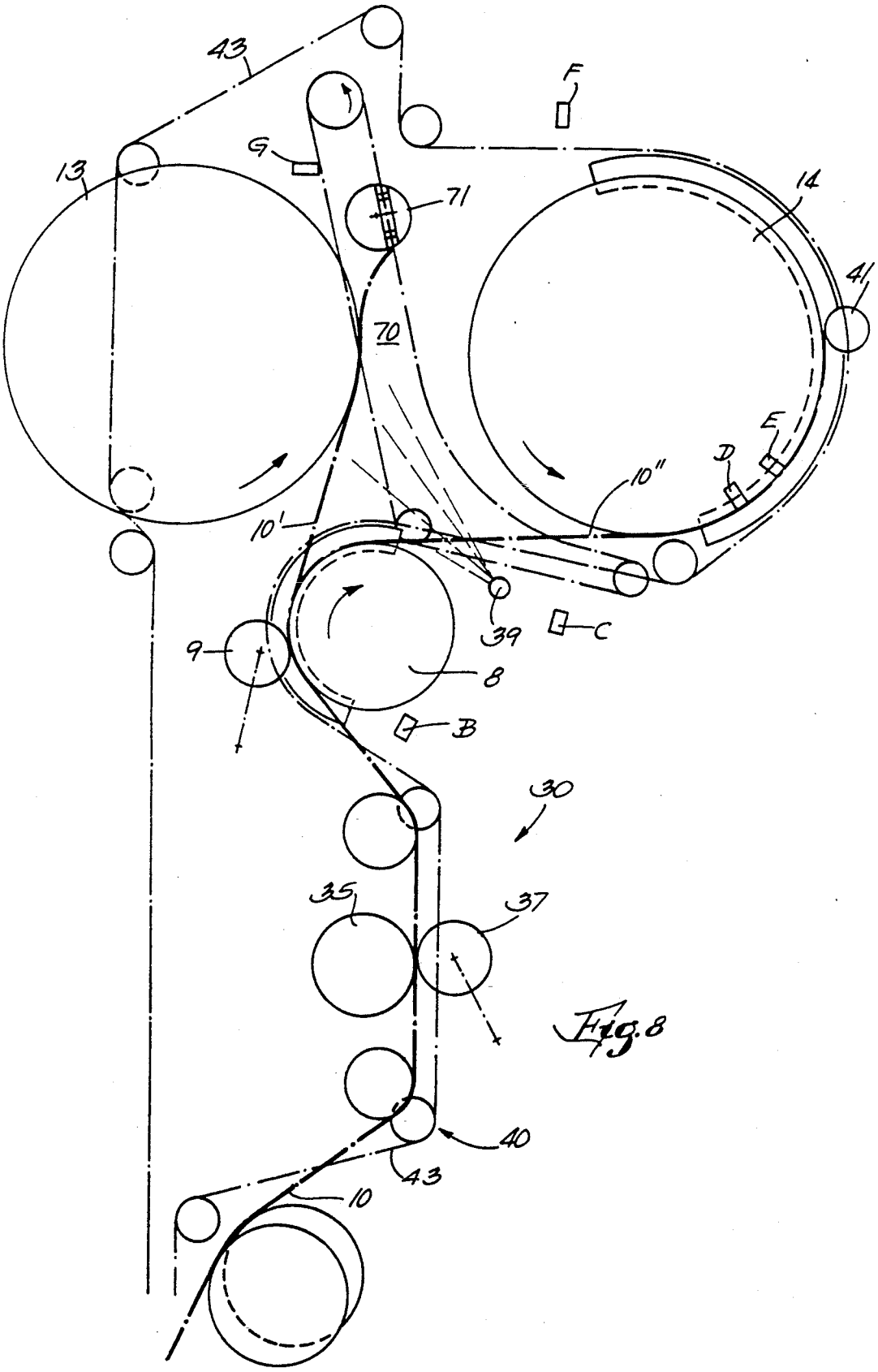

To avoid any creases forming in the freely hanging end pieces of the sub-webs 10' above the roller pair 8, 9 during the transition from the position of the suction tube 71 shown in FIG. 7 to the position shown in FIG. 8, an air jet tube 39 is provided with which the web ends can be held slightly tensioned.

As soon as the threading rod 41 leaves the proximity switch D the roll 1 and the support rollers 13, 14 are again accelerated to the threading speed. When the threading rod 41 has moved around the support roller 14 and has passed the proximity switch F, the machine is stopped. The suction tube 71 is stopped when it approaches a proximity switch G. The threading operation is thus terminated, with the sub-webs 10' and 10'' have been properly distributed, and the winding operation which has been described in conjunction with FIG. 2 can begin.

To enable the threading rod 41 to be connected to the end of the web 10 coming from the roll 1 in a subsequent threading operation, the threading rod 41, which has remained stationary in the region of the proximity switch F is moved back along its path up to the position 41' by appropriate reversal of the drive 16.

In the further embodiments of FIG. 9 through 12, identical reference numbers are used to denote functionally identical parts.

Figure 9:
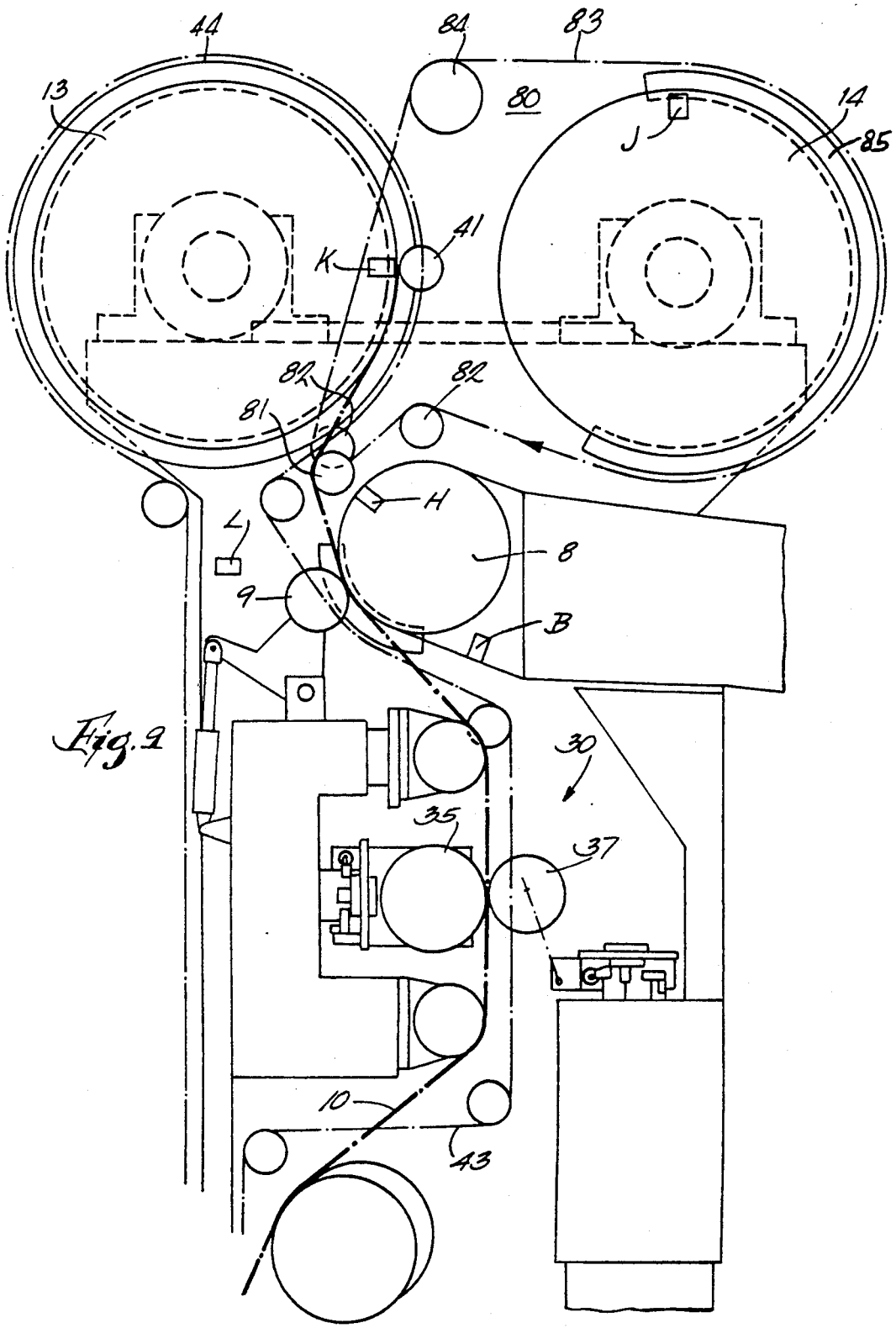
FIG. 9 is a view similar to FIG. 4, but showing a modified embodiment of the distributing device.
Figure 10:
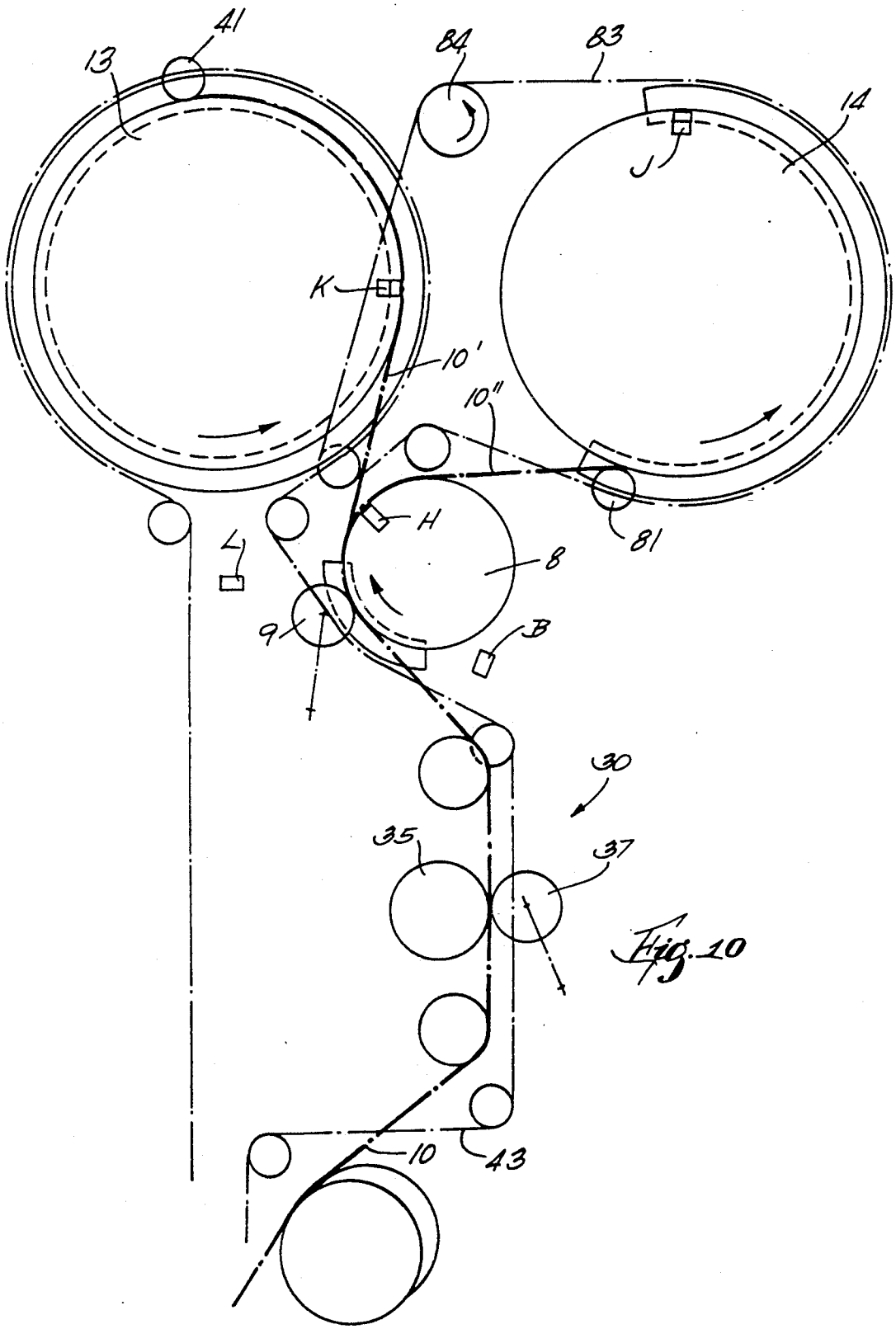
FIGS. 10 and 11 are simplified views corresponding to FIG. 9, and depicting different working phases of the distributing device.
Figure 11:
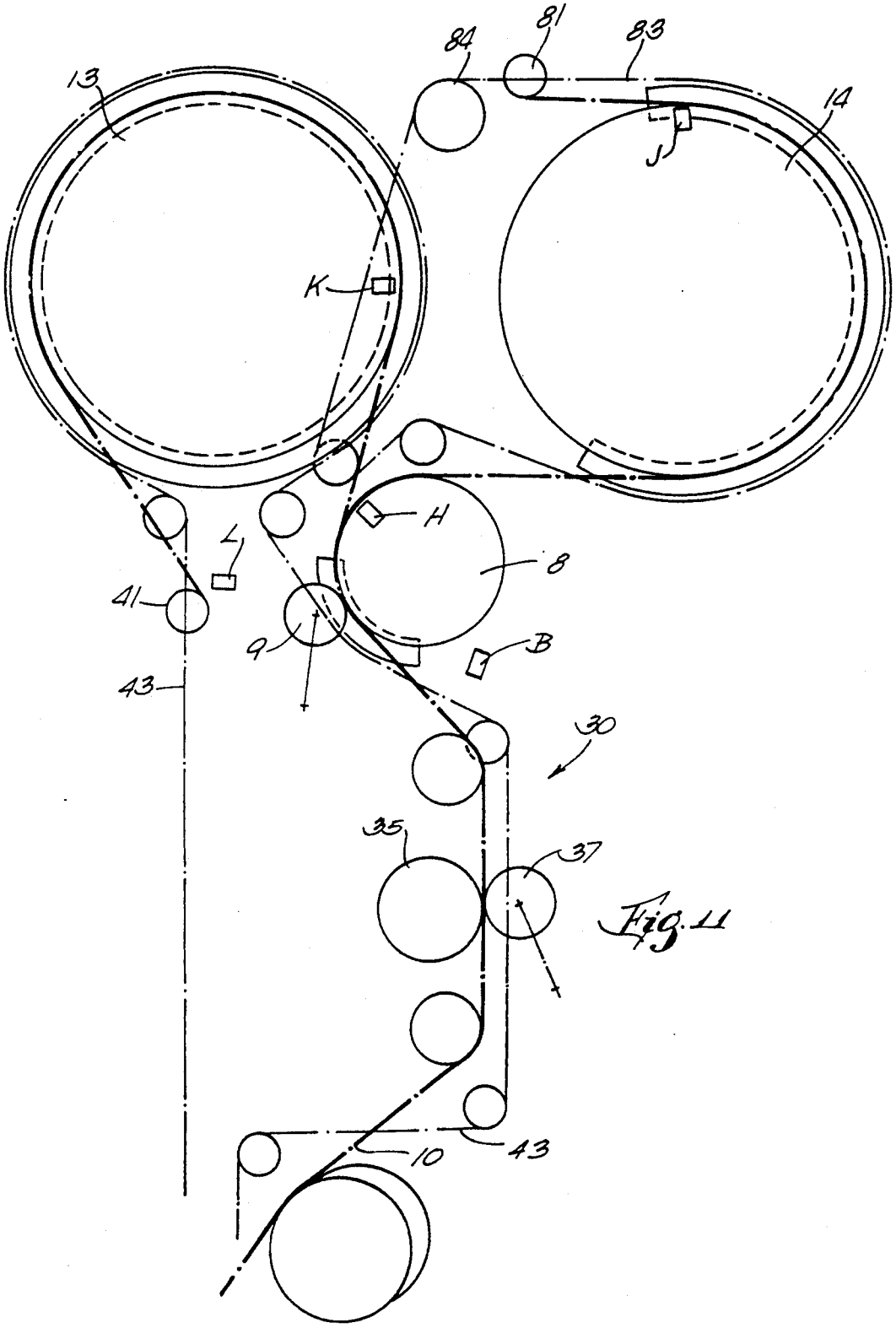

In the embodiment of FIGS. 9 to 11 the chain 43, instead of circling the right support roller 14, is led instead on a circular guide rail 44 around the left support roller 13, and another distributing device or transfer means 80 is provided for the support roller 14. The transfer means 80 includes a chain 83 on which a transport rod 81 extending transversely over the width of the web 10 can be displaced along an endless path. The chains 83, which are disposed on both sides of the web, run about the support roller 14 on a semicircular guide rail 85. A drive 84 for the chains is arranged between the support rollers 13, 14 at the level of the upper apex of the support rolls, and deflection rollers 82 in the lower region of the support rollers 13 and 14 further direct the chains.

In the operation of this embodiment, when the web 10, which is secured to the threading rod 41, has passed the cutting station and the guide roller 8, and has arrived at the proximity switch H, the previously downwardly pivoted pressure roller 9 is again pivoted against the guide roller 8 so that the web 10 cannot slip back, as in the previous embodiment. On the continuation of threading, the threading rod 41 passes very closely past the support roller 13 so that all the sub-webs 10' and 10'' are gripped by the support roller 13 constructed as suction roller.

At the proximity switch K, which is arranged at approximately half the height of the roll 13 in the region of the inner side of the support roller 13, the drive of the threading rod 41 is stopped, and with a short delay, the roll 1, the guide roller 8, and the support rollers 13, 14 are stopped. During this time the transport rod 81 of the distributing device 80 on the chain 83 moves in the direction of the arrow into the sub-webs 10', 10'' so that the latter pass around the transport rod with a defined wrap angle. This phase is shown in FIG. 9.

The group 60 sub-webs 10'', intended for the right support roller 14, are cut off by hand between the transport rod 81 and the threading roll 41 and secured to the transport rod by adhering or clipping.

In response to a corresponding signal, the drives of the roll 1, the guide roller 8, the support rollers 13, 14 and the chain 83 are accelerated to the threading speed, the threading rod 41 continuing its path between the support rollers 13, 14 around the support roller 13, and the transport rod 81 bringing the sub-webs 10'' up to the support roller 14 This phase is shown in FIG. 10.

The transport rod 81 and the threading rod 41 continue along their paths until they are stopped by the proximity switches J and L respectively. The sub-webs 10', 10'' are then gripped by the suction effect of the support rollers 13, 14. By means of the take-up units 28, 29 (FIG. 2), after separating from the transport rod 81 or the threading rod 41, the sub-webs can be coiled to narrower rolls 23, 24.

The position of the threading rod 41 shown in FIG. 11 is the inoperative position. When a new threading operation is about to start, the drive 16 is again set in motion. In this embodiment, however, the direction of movement is retained until the threading rod 41 has again reached the position 41' in FIG. 1.

Figure 12:
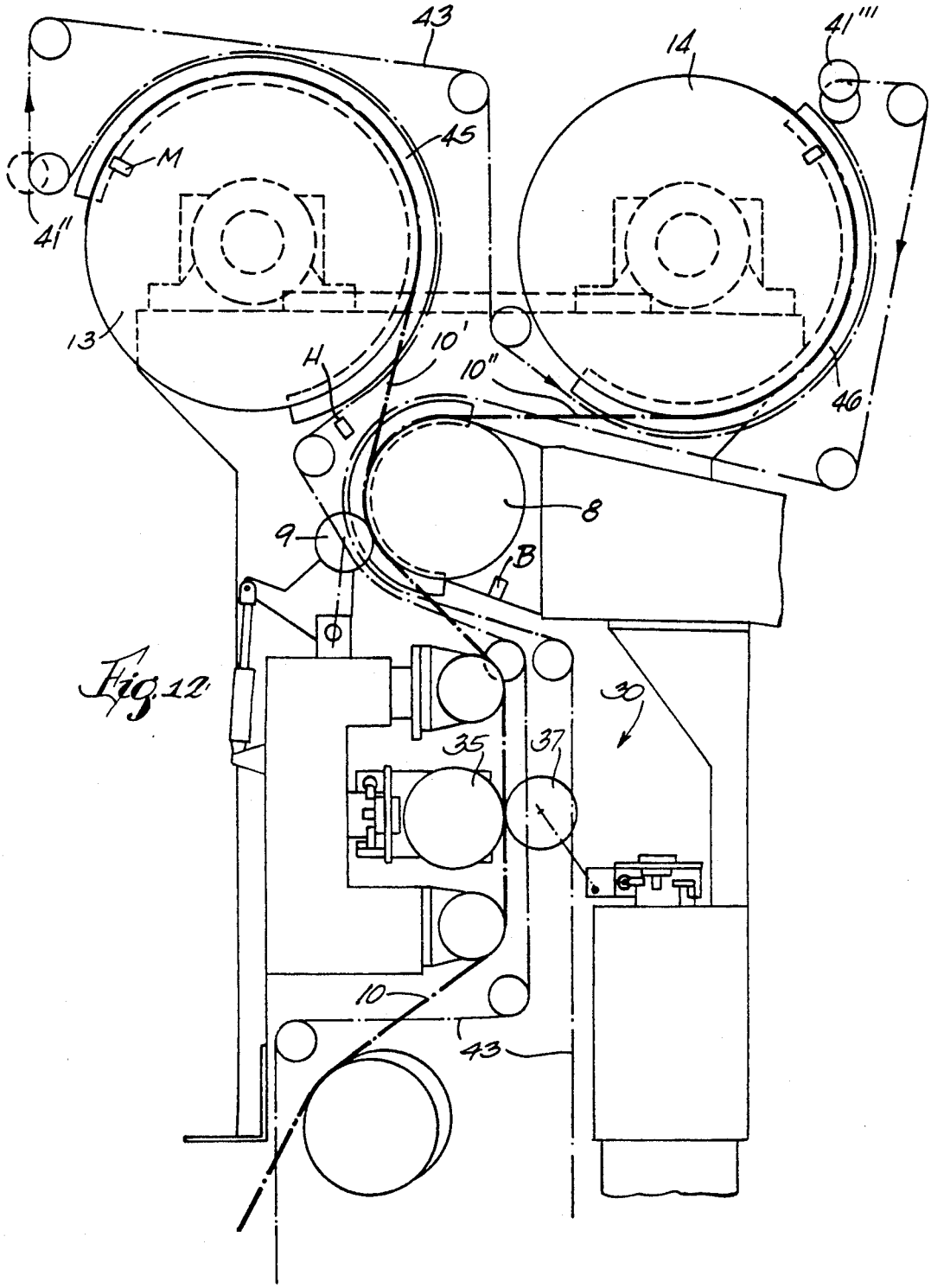
FIG. 12 is a view similar to FIG. 4 of yet another embodiment of the present invention.

In the embodiment of FIG. 12, no means corresponding to the distributing device 70 or 80 of the previous embodiments is present, but instead the threading apparatus 40 on the chain 43 moves the threading rod 41 consecutively past the two support rollers 13, 14.

When the threading rod 41 passes the guide roller 8 and thereafter the proximity switch H, and has thereby brought the pressure roller 9 into engagement with the web 10 or the guide roller 8, the threading rod moves on a circular guide rail 45 around the support roller 13, and is brought to a standstill near the proximity switch M in the position 41'' shown in dashed line in FIG. 12. The sub-webs 10' are cut off and remain on the support roller 13 formed as suction roller.

The threading rod 41 then continues its path along the chains 43 shown in FIG. 12, and moves downwardly between the support rollers 13, 14 in order then to pass around the support roller 14 on a circular guide rail 46 through an arc of about 180°. In this manner, the threading rod 41 can apply the ends of the sub-webs 10'' to the support roller 14. The proximity switch N stops the threading rod 41 in the position 41''' shown in full line in FIG. 12. To return to the starting position, the threading rod 41, after the ends of the sub-webs 10'' having been separated therefrom, continues its path again in the indicated direction on the chain 43.

In this embodiment as well, the starting of the winding takes place in the manner described in conjunction with FIG. 2.

It can be seen that the present invention provides means for fully threading separate take-up units on a web slitting machine, thereby promoting both efficiency in operation and safety of workers.

While several embodiments of a web threading apparatus have been shown and described in detail herein, various changes may be made without departing from the scope of the present invention.

I claim:

1. A web slitting machine on which a wide roll of a web of paper or the like can be continuously unwound, divided into a plurality of narrower strips and continuously rewound into narrower rolls, comprising:

an unwinding station for the wide roll;

a cutting station in which the wide web can be longitudinally divided by means of at least one longitudinal cutting means into narrower sub-webs;

a take-up station comprising a plurality of take-up units by means of which the sub-webs can be rewound to narrower rolls, the take-up units associated with adjacent sub-webs belonging to different groups of take-up units, the take-up units of the group having substantially aligned winding axes which are spaced from the substantially aligned winding axes of the other group;

a guide means for guiding the web along a path from the unwinding station through the cutting station to the take-up station;

a threading device operable along said guide means for capturing the end of the web to be unwound and drawing the web along the path defined by the guide means through the cutting station and up to the take-up station;

said threading device further including a first path for carrying at least a sub-web up to a take-up unit of one group and a second path for carrying an adjacent sub-web to a take-up unit of a second group and a single threading rod operating along a threading rod guide means defining said first path firstly to draw all sub-webs for said first group to said take-up units of said first group, and thereafter said threading rod operating along a threading rod guide means defining said second path to draw all webs of said second group to said take-up units of said second group.

2. A web slitting machine on which a wide roll of a web of paper or the like can be continuously unwound, divided into a plurality of narrower strips and continuously rewound into narrower rolls, comprising:

an unwinding station for the wide roll;

a cutting station in which the wide web can be longitudinally divided by means of at least one longitudinal cutting means into narrower sub-webs;

a take-up station comprising a plurality of take-up units by means of which the sub-webs can be rewound to narrower rolls, the take-up units associated with adjacent sub-webs belonging to different groups of take-up units, the take-up units of one group having substantially aligned winding axes which are spaced from the substantially aligned winding axes of the other group;

a guide means for guiding the web along a path from the unwinding station through the cutting station to the take-up station;

a threading device operable along said guide means for capturing the end of the web to be unwound and drawing the web along the path defined by the guide means through the cutting station and up to the take-up station;

said threading device including a first path for carrying at least a sub-web up to a take-up unit of one group and a second path for carrying an adjacent sub-web to a take-up unit of a second group said threading device further including a threading rod and a guide path for said threading rod adapted to draw said web beyond said cutting station and for drawing the sub-webs of one of said groups to the take-up units for said one group, and a separate transfer means associated with said threading device for drawing the others of said sub-webs to the take-up units for the other group.

3. A web slitting machine as defined in claim 2, in which said separate transfer means includes an elongate gripping element extending transversely of the web.

4. A web slitting machine as defined in claim 3, in which endless flexible pulling members are provided for moving said elongate gripping elements, said endless flexible pulling members being conducted over deflection rollers generally along said path defined by said guide means.

5. A web slitting machine on which a wide roll of a web of paper or the like can be continuously unwound, divided into a plurality of narrower strips and continuously rewound into narrower rolls, comprising:

an unwinding station for the wide roll;

a cutting station in which the wide web can be longitudinally divided by means of at least one longitudinal cutting means into narrower sub-webs;

a take-up station comprising a plurality of take-up units by means of which the sub-webs can be rewound to narrower rolls, the take-up units associated with adjacent sub-webs belonging to different groups of take-up units, the take-up units of one group having substantially aligned winding axes which are spaced from the substantially aligned winding axes of the other group;

a guide means for guiding the web along a path from the unwinding station through the cutting station to the take-up station;

a threading device operable along said guide means for capturing the end of the web to be unwound and drawing the web along the path defined by the guide means through the cutting station and up to the take-up station;

said threading device further including a first path for carrying at least a sub-web up to a take-up unit of one group and a second path for carrying an adjacent sub-web to a take-up unit of a second group said threading device including a first elongate gripping element extending transversely of the web width, means for attaching the web end at the unwinding station to the first gripping element, and means for moving said first gripping element along a path defined by said guide means through said cutting station, and around one support roll, and a second elongate gripping element operating along a path to capture sub-webs from said first gripping element and carry them to the take-up units of a second group.

6. A web slitting machine on which a wide roll of a web of paper or the like can be continuously unwound, divided into a plurality of narrower strips and continuously rewound into narrower rolls, comprising:

an unwinding station for the wide roll;

a cutting station in which the wide web can be longitudinally divided by means of at least one longitudinal cutting means into narrower sub-webs;

a take-up station comprising a plurality of take-up units by means of which the sub-webs can be rewound to narrower rolls, the take-up units associated with adjacent sub-webs belonging to different groups of take-up units, the take-up units of one group having substantially aligned winding axes which are spaced from the substantially aligned winding axes of the other group; and with each of said groups a support roller is associated on which the narrower rolls are wound, a guide means for guiding the web along a path from the unwinding station through the cutting station to the take-up station;

a threading device operable along said guide means for capturing the end of the web to be unwound and drawing the web along the path defined by the guide means through the cutting station and up to the take-up station;

said threading device including a first path for carrying at least a sub-web up to a take-up unit of one group and a second path for carrying an adjacent sub-web to a take-up unit of a second group and a gripping element and a path guiding said gripping element first around one support roller and then partially around the other support roller.

7. A web threading apparatus for a web slitting machine having an unwind station, a cutting station and first and second grips of take-up units for winding sub-webs created at said cutting station into narrower rolls, said first and second groups being spaced from each other, said web threading apparatus including:

a gripping element operable during threading for capturing the end of the unslit web at the unwind station and for drawing said web to said cutting station, and to draw all sub-webs created at said cutting station beyond said cutting station;

first path means for guiding said gripping element during threading to one of said first and second groups of take-up units for depositing a first group of sub-webs at said one group; and second path means for guiding said gripping element during threading to the other of said first and second groups for depositing a second set of sub-webs with said second group.

* * * * *